US005725599A

United States Patent [19]

Danner et al.

[11] Patent Number: 5,725,599

[45] Date of Patent: Mar. 10, 1998

[54] PROCESS FOR MINERAL TANNING, RE-TANNING OR LEATHER AFTER-TREATMENT

[75] Inventors: Bernard Danner, Riedisheim, France; Eckardt Häuser, Backnang, Germany; Jürg Heller, Oberwil, Switzerland; Heribert Schmitz, Heilbronn, Germany; André Vallotton, Aesch, Switzerland

[73] Assignee: Clariant Finance (BVI) Limited, Tortola, Virgin Islands (Br.)

[21] Appl. No.: 407,339

[22] Filed: Mar. 20, 1995

Related U.S. Application Data

[63] Continuation of Ser. No. 158,745, Nov. 30, 1993, abandoned, which is a continuation of Ser. No. 932,479, Aug. 20, 1992, abandoned.

[30] Foreign Application Priority Data

Aug. 22, 1991 [DE] Germany ..... 41 27 818.6

[51] Int. Cl.[6] ..... C14C 3/18; C14C 3/08

[52] U.S. Cl. ..... 8/94.21; 8/94.22; 8/94.25; 8/94.26; 8/94.27; 8/94.28; 8/94.29; 8/94.33; 8/94.19 C

[58] Field of Search ..... 8/94.21, 94.22, 8/94.25, 94.26, 94.27, 94.28, 94.29, 94.33, 94.19 C

[56] References Cited

U.S. PATENT DOCUMENTS

| | | | |
|---|---|---|---|
| 3,890,291 | 6/1975 | Vogt et al. | 260/80.3 |
| 4,596,581 | 6/1986 | Hohr et al. | 8/94.21 |
| 4,622,425 | 11/1986 | Gagne | 562/595 |
| 4,740,210 | 4/1988 | Amati et al. | 8/94.23 |
| 4,750,906 | 6/1988 | Schmidt | 8/94.18 |
| 4,778,476 | 10/1988 | Amati | 8/94.23 |
| 4,902,298 | 2/1990 | D'Elia | 8/94.33 |
| 4,919,680 | 4/1990 | Wehling et al. | 8/94.27 |
| 4,973,427 | 11/1990 | Amati et al. | 252/354 |
| 5,130,369 | 7/1992 | Hughes et al. | 524/846 |
| 5,306,435 | 4/1994 | Ishikawa et al. | 252/8.57 |
| 5,464,451 | 11/1995 | Denny et al. | 8/94.21 |

FOREIGN PATENT DOCUMENTS

| | | |
|---|---|---|
| 3005699 | 8/1981 | Germany . |
| 1524013 | 9/1978 | United Kingdom . |

OTHER PUBLICATIONS

Encyclopedia of Chemical Technology, Kirk–Othmer, Third Edition, vol. 14, "Laminated Wood–Based Composites to Mass Transfer", pp. 208–221 & 228–231 (1981) (No Month).

Chemical Abstract 96:8482m "Tanning compositions containing aluminum salts", Feuer, B., (FR2463810) (Feb. 27, 1981).

Derwent Abstracts of : US4622425; US4750906; DE3005669; DE3406912; ES2010132; SU1475919; SU1447853; FR2463780.

Encyclopedia of Chemical Technology, Kirk–Othmer, Third Edition, vol. 14, pp. 208–221, pp. 228–231, 1981.

*Primary Examiner*—Glenn Caldarola
*Assistant Examiner*—Walter D. Griffin
*Attorney, Agent, or Firm*—Gabriel Lopez; Michael P. Morris

[57] ABSTRACT

A process for the production of mineral tanned or/and re-tanned or/and after-treated leather or pelt, wherein before the mineral tanning, directly after the mineral tanning, directly before the mineral re-tanning, after the mineral re-tanning or/and with the after-treatment of a fatliquoring with a polyvalent metal cation, the substrate is treated with (A) a polymeric carboxylic acid containing α-hydroxyacrylic acid units, optionally in salt form, as constituent units of the polymer, by which a high exhaustion of mineral (re)tanning agent, an excellent distribution of the tanning agent and very pleasant soft handle of the (re)tanned leather resp. an outstanding water resistance of mineral after-treated fat-liquored leather can be achieved.

22 Claims, No Drawings

PROCESS FOR MINERAL TANNING, RE-TANNING OR LEATHER AFTER-TREATMENT

This is a continuation of application Ser. No. 08/158,745, filed Nov. 30, 1993, now abandoned, which in turn is a continuation of application Ser. No. 07/932,479, filed Aug. 20, 1992, now abandoned.

In the production of mineral tanned and/or re-tanned leather it is desired to keep the yield and efficiency of the mineral tanning agent as high as possible, be it in order to achieve a high-yield mineral (re)tanning or in order to decrease as far as possible the residual mineral tanning agent content of the back-water. In the after-treatment of leather with fatting agents—particularly such with hydrophobizing properties—that are fixed with polyvalent metal cations, it is also desired to improve the yield and efficiency of the treatment.

It has now been found that using defined anionic polymeric compounds these aims can be attained in a surprisingly high degree.

The invention thus provides a process for the production of mineral tanned or/and retanned or/and after-treated leather or pelt, wherein before a mineral tanning, directly after a mineral tanning, directly before a mineral re-tanning, after a mineral re-tanning or/and with the after-treatment of a fatliquoring with a polyvalent metal cation, the substrate is treated with (A) a polymeric carboxylic acid containing α-hydroxyacrylic acid units, optionally in salt form, as constituent units of the polymer.

As polymeric carboxylic acids (A) or their salts come principally into consideration (co)poly-α-hydroxyacrylic acids, optionally further containing non-ionic and/or other anionic co-monomeric units as constituents of the polymer or their salts. The other anionic co-monomeric units—indicated in the free acid form—are advantageously derivatives of ethylenically unsaturated monomeric carboxylic acids (principally of aliphatic $C_{3-5}$-carboxylic acids), in particular (meth)acrylic acid, crotonic acid, maleic acid, itaconic acid, aconitic acid and citraconic acid, among which maleic acid and (meth)acrylic acid are preferred, especially acrylic acid. As non-ionic monomeric units come principally into consideration the derivatives of (meth)acrylamide, (meth)acrylonitrile and/or vinylmethylether. Copolymers comprising α-hydroxyacrylic acid units and acrylic acid units and/or their salts or, in particular, consisting thereof are preferred. As "derivatives" of the monomers are meant here monomer units deriving from the copolymerisation of the mentioned monomers.

The numerical average molecular weight $\overline{M}_n$ of the polymers (A) is advantageously in the range of 500 to 100,000, preferably 600 to 30,000. Of the polymers to be employed are furthermore preferred those whose weight average molecular weight $\overline{M}_w$ is in the range of 1000 to 500,000, preferably 1000 to 250,000. The indicated molecular weights are intended in the form of the sodium salts of the polymeric acids.

The proportion of α-hydroxyacrylic acid units (in particular a sodium salt) may range up to 100 mol-% of the polymer, advantageously it is in the range of 5 to 70 mol-%, preferably <50 mol-%, more preferably in the range of 10 to 50 mol-%, especially 10 to 30 mol-%, of the polymer.

The polymers (A) to be employed according to the invention, may be produced in a manner known per se, e.g. according to the method described in Swiss Patent 669 952 or GB-Patent Nr. 1 524 013, the content of which is incorporated herein by reference.

Advantageously the polymers (A) are produced using as starting monomer an α-halogenacrylic acid, preferably α-chloroacrylic acid, in the form of the free acid or of a hydrosoluble salt, in particular an alkali metal salt (e.g. lithium, sodium or potassium salt) or/and ammonium salt, and optionally further monomers as indicated above, the other anionic monomers being also employed in the form of the free acids or of hydrosoluble salts thereof, advantageously alkali metal or/and ammonium salts. The polymerisation takes place advantageously in aqueous medium, under acidic conditions, at elevated temperatures e.g. at temperatures between 50° and 150° C., preferably in the range of 80° to 105° C., suitably in the presence of a polymerisation catalyst, which advantageously is a peroxy-compound or a mixture of peroxy-compounds, preferably hydrogenperoxide or/and potassium peroxydisulphate, and optionally also in the presence of a polymerization regulator (chain transfer catalyst), e.g. thioglycolic acid. The catalyst is suitably employed in an efficient amount, e.g. in the range of 0.001 to 0.5 mole, preferably 0.01 to 0.35 moles of catalyst per mole of monomers.

After the acidic polymerisation the polymers are advantageously converted to the corresponding salt form by reaction with a base. There may be employed for instance alkali metal hydroxides (NaOH, LiOH, KOH) or ammonia, among which alkali metal hydroxides are preferred, especially sodium hydroxide.

As mineral tanning agents that may be employed in the process of the invention (be it as main tanning agent or as re-tanning agent or further as a constituent of a combined tanning agent) there may be employed conventional known mineral tanning agents, e.g. chromium-, alum-, zirconyl-, iron- and/-or titanium-based tanning agents (e.g. as described in F. Starher "Gerbereichemie und Gerbereitechnologie", 1967, in chapters 16 and 17) among which the chromium-based tanning agents are preferred. Most preferably there are employed partially basified chromium-sulphates as conventionally used in tanning technique.

The products (A) to be used according to the invention may be employed before or/and directly after the mineral tanning or/and directly before the mineral re-tanning or/and after the mineral re-tanning.

As "directly after tanning" or "directly before re-tanning" there is meant here such a sequence of operational stages that excludes an intermediate rinsing or washing, in particular so that the two involved process steps of the addition of (A) and addition of mineral (re)tanning agent are carried out sequentially in the same liquor, i.e. so that either the treatment with (A) is a successive step after the tanning in the used tannage liquor, or it is an immediately preceding step before the re-tanning, essentially so that at least a part of the re-tanning agent is given into the exhausted liquor of the treatment with (A). "Before a mineral tanning" means here any stage or moment before the addition of the mineral tanning agent for a mineral main tanning. "After a mineral retanning" means here any moment or stage after the addition of at least a part of a mineral retanning agent, e.g. even after a subsequent dyeing and/or fatliquoring.

If the products (A) are employed before the tanning, they may e.g. be employed in any operational stage between bating and tanning, preferably in the pickle or, more preferably, subsequent to the pickling stage, in the exhausted pickle liquor, in which are still present the pickled hides, skins or pelts. (As a pelt there is intended a hair-bearing skin). The treatment with (A) before the tanning may be carried out advantageously at temperatures between 10° and 40° C., preferably 15° and 30° C., and under strongly acidic conditions, advantageously at pH-values <4.5, preferably between 2.5 and 4.0, in particular between 2.5 and 3.5. The polymers (A) are conveniently employed in an efficient concentration as is sufficient in order to achieve the desired effect, advantageously in the range of 0.04 to 4% by weight of (A) (calculated as sodium salt) referred to the weight of the hide or skin, or 0.02 to 2% by weight of (A) (calculated as sodium salt) referred to the weight of the pelt. Referred to the weight of the hide or skin, there are employed preferably 0.1 to 1.5% by weight of (A) (calculated as sodium salt). The treatment is suitably continued until at least the major proportion of the product has built-up on the substrate. The treatment duration may vary depending on the kind and constitution of the substrate; advantageously the treatment duration is in the range of 20 minutes to 1½ hours, in particular 30 to 75 minutes. If desired, before the tanning there may be employed de-greasing agents (e.g. for pickled sheep-skins) or/and, if required, also fatting agents; such additives have no negative influence on the efficiency of (A). The mineral tanning may be carried out in conventional way, whereby since the exhaustion of the tanning agent is increased due to (A), minor amounts of mineral tanning agents, in particular chrome-based tanning agent, are sufficient in order to obtain a good mineral tanning and the quantity of mineral tanning agent may be correspondingly reduced due to the increased exhaustion effect. Furthermore, due to the presence of (A), the distribution of the tanning agent in the substrate may be improved (macroscopically and microscopically) so that together with an increased exhaustion of the tanning agent, there may be achieved leathers of outstanding softness and with excellent fineness and firmness of the grain, the further physical properties not being impaired.

As substrates for this process variation are suitable any conventional hides, skins and pelts as are in general employed for mineral tanning, e.g. hides from cow, calf or buffalo (e.g. also as split hides), skins from goat, sheep or pig, buckskins and pelts.

The polymers (A) may however also be given directly after the tanning into the already used tannage liquor, in order to improve the exhaustion of the mineral tanning agent or/and to fix the already exhausted tanning agent. Suitable temperatures for this are in particular in the range of 10° to 60° C., preferably 20° to 50° C.; the pH-values are advantageously in the distinctly acidic range, in particular at pH <6, preferably <5, with particular preference in the range of 2.5 to 4.5; the duration of the treatment and the concentration of the product (A) are advantageously in the same general and also preferred ranges as described above for the treatment before the tanning.

The products (A) may also be employed directly before a re-tanning and/or, preferably, after a re-tanning, in which there is employed a mineral tanning agent, especially such as described above. The suitable and, in particular, also the preferred concentrations, temperatures, pH-values and treatment durations may range in the same general and also preferred scopes as described above, in particular as described above for the treatment after the tanning.

The choice of optimum parameters may vary depending on the substrate, the pre-treatment and the treatment method and may be determined by means of a few preliminary tests.

Preferably the products (A) are employed either after a mineral re-tanning or/and with particular preference before a mineral main tanning, especially after pickling.

A mineral re-tanning may also follow a non-mineral main tanning, e.g. a vegetable and/or synthetic tanning and the mineral tanning agents may optionally also be combined with other tanning agents, e.g. with vegetable tanning agents and/or with syntans.

The leathers and/or pelts that have been (re)tanned according to the invention, may be used in the same way as leathers and/or pelts tanned in any other way, e.g.—depending on the respective process-stage—for dyeing, fat-liquoring and/or finishing with any conventional products suitable therefor.

The mineral (re)tanned leathers or pelts produced using (A), according to the invention, are distinguished by an outstanding fine distribution of the mineral tanning agent in the substrate, by an excellent firmness and fineness of grain and by a very pleasant soft handle.

In chrome tanning a particularly good chrome-exhaustion can be additionally achieved by toning down the acidity in a chrome-tanning carried out subsequently to a treatment with (A), in particular by increasing the pH to values preferably up to 4.5; in doing so the temperature may also be slightly increased [thus after a treatment with (A) at pH <4.0, in particular of 2.5 to 3.5, and at temperatures in the range of 10° to 30° C., the pH is advantageously increased to values in the range of 3.5 to 4.5, preferably 3.6 to 4.1, and the temperature is advantageously increased to values in the range of 25° to 45° C., preferably 30° to 40° C.].

Since the exhaustion of the mineral tanning agent may be significantly improved according to the invention, the required amount of mineral tanning agent (especially chromium-based tanning agent) may be significantly reduced, e.g. to concentrations corresponding to 0.8 to 3.5% by weight of $Cr_2O_3$, referred to the weight of hide or skin, or 0.5 to 1.8% by weight of $Cr_2O_3$, referred to the weight of pelt. For every part by weight of mineral tanning agent (calculated as metal oxide, in particular $Cr_2O_3$) there are employed advantageously 0.05 to 1, preferably 0.1 to 0.8 parts by weight of (A) (calculated as sodium salt).

According to a variant of the process of the invention, the polymers (A) are employed in the fixation of fat-liquorings—in particular such with hydrophobizing properties—with polyvalent metal cations. Such fat-liquorings are advantageously carried out as conclusive treatment, mostly after a dyeing. As fat-liquorings with hydrophobizing properties that may be fixed with polyvalent metal cations come mainly into consideration such that are carried out with synthetic fatting agents, principally such on phosphoric acid partial ester basis. As fatting phosphoric acid partial ester come in general into consideration known compounds, essentially simple or oligomeric phosphoric acid partial esters of optionally oxyethylated fatty alcohols and optionally (cyclic or non-cyclic) alkane diols. The fatty alcohols contain e.g. 12 to 24 carbon atoms, their oxyethylation degree is e.g. in the range of 0 to 10, the alkane diols contain advantageously 2 to 6 carbon atoms, the degree of oligomerisation (i.e. the number of alkanedioxy bridges each connecting two phosphorus atoms) is e.g. in the range of 0 to 4, advantageously 1 or 2. These partial esters may be in the form of alkali metal or/and ammonium salts. Such esters are in general known and are described e.g. in EP 87 799 B1 and in DE-OS 32 30 925 (≡U.S. Pat. No. 4,778,476) and DE-OS 35 04 308 (≡U.S. Pat. Nos. 4,740,210 and 4,973,427), which are incorporated herein by reference. A fat-liquoring with such esters may also be combined with a fat-liquoring with other conventional fat-liquors, e.g. as described in DE-OS 35 04 308 resp. U.S. Pat. Nos. 4,740,210 and 4,973,427. The polyvalent metal cations employed for fixation may advantageously be employed in the form of mineral tanning agents, principally such as described above, among which before all the chrome-tanning agents are preferred. The treatment with (A) takes place advantageously after the treatment with the fatting agent, in particular with the phosphoric acid derivative, and the fixation with the mineral polyvalent metal compound is advantageously carried out subsequently to the treatment with (A). Suitable concentrations, pH-ranges and temperatures for the treatment with the phosphoric acid partial esters are in particular as indicated in the above reference literature, preferably 0.2 to 15% of phosphoric acid partial ester, referred to the weight of the substrate, pH preferably in the range of 4 to 7, temperature advantageously in the range of 20° to 70° C., preferably 30° to 60° C. The treatment with (A) takes place advantageously at temperatures in the range 15° to 60° C., preferably 20° to 50° C., advantageously at pH-values in the range of 2.5 to 6, preferably 3 to 5, with particular preference after the lowering of the pH by acid addition, optionally in a fresh bath. The concentration of (A), indicated as Na-salt referred to the substrate, is advantageously in the range of 0.2 to 10, preferably 0.5 to 5%. The fixation with the mineral polyvalent metal compounds takes place advantageously at the same temperatures and pH-values as indicated for (A) and at concentrations, which are advantageously in the range of 1 to 100%, preferably 2 to 20% polyvalent metal cation, referred to the employed phosphoric acid partial ester. The so treated leather or pelt, may then, optionally after washing or rinsing, be dried and cured in conventional way. By this after-treatment there may be obtained excellently fat-liquored leathers or pelts of pleasant full handle and very good water resistance (in particular as can be assessed by means of a penetrometer test).

In the following Examples parts and percentages are by weight and the temperatures are indicated in degrees Celsius. The molecular weights of the polymers are assessed by means of gel-permeation chromatography (standard: polyacrylic acid) at pH 6–7 in the respective sodium salt form. In the Application Examples percentages refer to the weight of the substrate, if there is not clearly intended the concentration of a solution or the basicity of chromium sulphate; "C.I." stands for "Colour Index".

EXAMPLE 1

51.2 parts of water are heated to 90° C. 528.0 parts of an aqueous 19.6% solution of sodium α-chloroacrylate, 137.6 parts of acrylic acid, 69.6 parts of a solution of 1.0 part of potassium persulphate and 32 parts of hydrogenperoxide (of 35% strength) in 36.6 parts of water are then simultaneously added dropwise during 60 minutes and the temperature is maintained between 95° and 100° C. The mixture is then stirred for further 3 hours at 95°–100° C. 288.0 parts of an aqueous 30% sodium hydroxide solution are now added dropwise at 95° C. during 40 minutes and the obtained solution is heated during 5 hours to 95°–100° C. and then cooled to ambient temperature. The pH-value is about 7.3 and is set to 8.0 with 2.8 parts of an aqueous 50% sodium hydroxide solution. There are obtained 1077.2 parts of an aqueous 19.36% solution [Product (1)] of the sodium salt of a copolymer which, referred to free acid, is an acrylic acid(7)/α-hydroxyacrylic acid(3) copolymer. (Molecular weights of the copolymer: $\overline{M}_n = 2.07 \cdot 10^4$, $\overline{M}_w = 2.09 \cdot 10^5$).

EXAMPLE 2

172.8 parts of water are heated to 90° C. Then 1782.0 parts of an aqueous 19.6% sodium α-chloroacrylate solution, 464.4 parts of acrylic acid, 137.7 parts of a solution consisting of 3.4 parts of potassium persulphate 10.8 parts of hydrogen peroxide (strength: 35%)

123.5 parts of water and 324.0 parts of an aqueous 30% sodium hydroxide solution are simultaneously and regularly added dropwise thereto during 60 minutes, and the temperature is maintained between 95° and 100° C. The obtained mixture is then stirred for further 3 hours at 95°–100° C. 648.0 parts of an aqueous 30% sodium hydroxide solution are now added dropwise, during 40 minutes, at 95° C. and the obtained solution is heated for 5 hours to 95°–100° C. and then cooled to ambient temperature. The pH-value is about 7.3 and is adjusted to 8.0 with 21.4 parts of an aqueous 50% sodium hydroxide solution. There are obtained 3550.3 parts of an aqueous 19.82% solution [Product (2)] of the sodium salt of a copolymer, which (referred to the free acid) is an acrylic acid(7)/α-hydroxyacrylic acid(3) copolymer. (Molecular weights of the copolymer: $\overline{M}_n = 1.58 \cdot 10^4$, $\overline{M}_w = 1.48 \cdot 10^5$).

EXAMPLE 3

64.0 parts of water are heated to 90° C. 660.0 parts of an aqueous 19.6% solution of sodium α-chloroacrylate, 172.0 parts of acrylic acid and 51.0 parts of a solution of 1.2 parts of potassium persulphate and 4 parts of hydrogen peroxide (strength 35%) in 45.8 parts of water are then added simultaneously thereto dropwise during 60 minutes and the obtained solution is heated for 3 hours to 95°–100° C. 360.0 parts of an aqueous 35% sodium hydroxide solution are then added dropwise thereto at 95° C. and heating is continued for further 5 hours at 95°–100° C.; then the obtained mixture is cooled to ambient temperature and its pH is adjusted to 8.5 with 1.0 part of 50% sodium hydroxide solution. There are obtained 1308.0 parts of a 19.92% solution [Product (3)] of the sodium salt of a copolymer, which (referred to the free acid) is an acrylic acid(7)/α-hydroxyacrylic acid(3) copolymer. (Molecular weights of the copolymer: $\overline{M}_n = 1.3 \cdot 10^4$, $\overline{M}_w = 8.8 \cdot 10^4$).

EXAMPLE 4

The procedure described in Example 3 is repeated using, however, the following ingredients quantities:

| | |
|---|---|
| Water heated to 90° C. | 341.0 parts |
| simultaneous dropwise addition of: | |
| aqueous 19.6% sodium α-chloroacrylate solution | 234.1 parts |
| acrylic acid | 235.0 parts |
| solution consisting of<br>1.2 parts of potassium persulphate<br>8.0 parts of hydrogen peroxide (35%)<br>53.8 parts of water | 63.0 parts |
| dropwise addition at 95° C. of<br>30% sodium hydroxide solution | 420.0 parts |
| adjustment of the pH-value to about 8.5 with<br>50% sodium hydroxide solution | 8.6 parts. |

In order to adjust the molecular weight 0.5 parts of thioglycolic acid are added to the starting 341.0 parts of water, which are heated to 90° C.

There are obtained 1302.2 parts of an aqueous 20.46% solution [Product (4)] of the sodium salt of a copolymer, which (referred to the free acid) is an acrylic acid(9)/α-hydroxyacrylic acid(1) copolymer. (Molecular weights of the copolymer: $\overline{M}_n = 8.6 \cdot 103^3$, $\overline{M}_w = 9.3 \cdot 10^4$).

EXAMPLE 5

The procedure described in Example 4 is repeated using, however, the following ingredients quantities:

| | |
|---|---|
| water, which is heated to 90° C. | 200.0 parts |
| thioglycolic acid | 0.25 parts |
| simultaneous dropwise addition of: | |
| aqueous 19.6% sodium α-chloroacrylate solution | 483.6 parts |
| acrylic acid | 212.5 parts |
| solution consisting of<br>1.2 parts of potassium persulphate<br>4.0 parts of hydrogen peroxide (35%)<br>53.8 parts of water | 59.0 parts |
| dropwise addition at 95° C. of<br>30% sodium hydroxide solution | 370.0 parts |
| adjustment of the pH-value to about 8.5 with<br>50% sodium hydroxide solution | 23.3 parts. |

There are obtained 1348.65 parts of an aqueous of 20.57% solution [Product (5)] of a sodium salt of a copolymer, which (referred to the free acid) is an acrylic acid(8)/α-hydroxyacrylic acid(2) copolymer. (Molecular weights of the copolymer: $\overline{M}_n=1.3\cdot10^4$, $\overline{M}_w=1.15\cdot10^5$).

Application Example A (The weight indications refer to the weight of the hide) Bated cow-hide (bated south-german cow-hides of the weight-class 30–39 kg, split thickness 2.0–2.2 mm), which was rinsed during 20 minutes with water of 20° C. and drained, is additioned with 100% of water of 20° C. and 8% of sodium chloride and drummed for 10 minutes in the tanning drum. Then 0.6% of formic acid, 0.8% of sulphuric acid and further 0.2% of sulphuric acid (each diluted 1:10 with water) are added sequentially, and drumming is continued for a total of 120 minutes. After dwelling over night at the following morning there is reached a pH of 2.9. To this liquor are added 2% of Product (3) according to Example 3, and the whole is drummed for 45 minutes. Then 4% of a 33% basic chromium sulphate powder is added thereto and drumming is continued for further 60 minutes. Upon addition of 0.6% of a neutralizing agent there is milled during 7 hours. The final temperature is 40° C. and the final pH is between 3.9 and 4.0. The residual chromium content of the liquor is 0.028% $Cr^{3+}$. The chromium content of the obtained wet-blue leather, referred to 0% humidity, is 2% $Cr^{3+}$.

Application Example B

The procedure described in Application Example A is repeated, with the difference that, in place of Product (3) according to Example 3, there is employed the same amount of Product (5) according to Example 5. The residual chromium content of the liquor is 0.088% $Cr^{3+}$. The chromium content of the obtained wet-blue leather, referred to 0% humidity, is 1.9% $Cr^{3+}$.

Application Example C

The procedure described in Application Example A is repeated, with the difference that, in place of Product (3) according to Example 3, there is employed the same amount of Product (4) according to Example 4. The residual chromium content of the liquor is 0.05% $Cr^{3+}$. The chromium content of the obtained wet-blue leather, referred to 0% humidity, is 1.9% $Cr^{3+}$.

Application Example D (blank) (comparative example)

The procedure described in Application Example A is repeated, with the difference that, in place of Product (3) according to Example 3, there is employed no chrome-exhaustion assistant. The residual chromium content of the liquor is 0.14% $Cr^{3+}$. The chromium content of the obtained wet-blue leather, referred to 0% humidity is at 1.8% $Cr^{3+}$.

Application Example E (The weight indications refer to the weight of the hide)

Bated cow-hide (bated south-german cow-hides of the weight-class 30–39 kg, split thickness 2.014 2.2 mm; bated weight +15% =hide weight), which was rinsed during 20 minutes with water of 20° C. and drained, is additioned with 60% of water of 20 C. and 7% of sodium chloride and drummed for 10 minutes in the tanning drum. Then there are added thereto, in the indicated sequence, 1.0% of sodium formate, after 10 minutes 0.5% of formic acid and, after further 10 minutes, 1.1% of sulphuric acid (each diluted 1:10 with water) and drumming is continued for 60 minutes. Then the drum is switched to automatic drumming over night. At the following morning the pH is 3.2–3.4. From the bath there is drained off so much that the residual pickle-liquor is 50%. To this liquor are added x % of Product (3) according to Example 3, and the whole is drummed for 45 minutes. Then 7% of a 33% basic chromium sulphate powder is added thereto and drumming is continued for further 60 minutes. Upon addition of 0.6% of magnesium oxide the whole is milled during 6 hours. The final temperature is 40° C. and the final pH is between 4.0 and 4.2.

The employed amounts x, the residual chromium contents of the liquors in $Cr^{3+}$ and the chromium content of the obtained wet-blue leathers in % $Cr^{3+}$ referred to 0% humidity, are set out in the following table.

| x | 0% | 2% | 4% | 6% |
|---|---|---|---|---|
| residual $Cr^{3+}$ content of the liquor | 0,22% | 0,12% | 0,09% | 0,08% |
| $Cr^{3+}$ content of the wetblue leather | 4% | 5,1% | 5,2% | 5,4% |

Application Example F

Conventionally tanned, 2.0–2.2 mm trimmed chrome-leather is re-tanned as follows:

200% of water of 35° C.

3% of 33% basic chromium sulphate, powder 1.5% of sodium bicarbonate during 120 minutes. pH at the end of the treatment: 3.9.

200% of water of 35° C.

3% of 33% basic chromium sulphate, powder during 120 minutes. Then treatment with 1.4% of sodium bicarbonate and 1.0% of Product (2) according to Example 2, during 45 minutes.

pH-value at the end of the treatment: 4.0.

At the end of the treatment there are found the following $Cr^{3+}$ concentrations:

a. 263 mg/l b. 173 mg/l.

Application Example G

Chrome-tanned cow-leathers, wetblue, 1.8–2.0 mm, are re-tanned as follows:

150% of water, 35° C.

3% of 33% basic chromium sulphate, powder, 40° C., 75 minutes.

3% of Product (1) according to Example 1, 40° C., 45 minutes.

The final pH-value is 3.3.

d. 150% of water, 35° C.

3% of 33% basic chromium sulphate, powder, 40° C., 75 minutes.

The final pH-value is 3.3.

In the residual bath there are found the following $Cr^{3+}$ concentrations:

c. 208 mg/l d. 647 mg/l.

Application Example H

Chrome-tanned cow-leathers, wetblue, 1.8–2.0 mm, are re-tanned as follows:

150% of water, 40° C.

3% of 33% basic chromium sulphate, powder

1% of sodium bicarbonate during 120 minutes. pH at the end of the treatment: 3.9.

f. 150% of water, 40° C.

3% of 33% basic chromium sulphate, powder

1% of sodium bicarbonate during 120 minutes. Then treatment with 1.5% of Product (3) according to Example 3.

The final pH-value is 4.0.

In the residual bath there are found the following $Cr^{3+}$ concentrations:

e. 385 mg/l f. 251 mg/l.

After the retanning according to Application Examples F, G and H the liquor is drained off, the leather is rinsed with 300% of water of 20° C. during 10 minutes, the rinsing bath is drained off, and then neutralization, dyeing and fatliquoring is carried out in conventional way.

Application Example I

Chrome-tanned cow-leathers, wetblue, 1.8–2.0 mm, which was neutralized to pH 6.1, is washed with 300% of water at 50° C. during 10 Minutes, then the bath is drained off and the leather is dyed in a fresh bath of 100% of water at 50° C. and 1% of C.I. Acid Brown 359 during 15 minutes, then the following ingredients are added in the indicated sequence:

5% of the phosphoric acid partial ester according to Example 1 of EP 87 799 B1 (diluted 1:3 with water), 60 minutes at 50° C., 4% of mimosa extract (Weibull), 30 minutes at 50° C., 5% of the phosphoric acid partial ester according to Example 1 of EP 87 799 B1 (diluted 1:3 with water), 60 minutes at 50° C., 1% of formic acid (diluted 1:10 with water), 30 minutes at 20° C., up to pH 3.8, then the bath is drained off and in a new bath of 100% of water at 30° C. and 1% of Product (1) according to Example 1 drumming is continued for 30 minutes, after which 2.5% of chromium sulphate (33% basic) are added and drumming is continued for further 60 minutes at 30aC; then the bath is drained off and the leather is washed twice with each time 300% of water at 20° C. The bath is now drained off, the leather discharged, dried hanging over night, then curried and vacuum-dried during 2.5 minutes at 80° C. The obtained leather has a water resistance (by the Bally penetrometer test) that is superior to the one of the blank sample [i.e. a sample produced in the same way but without the addition of Product (1)].

Application Example J

The procedure of Application Example I is repeated, with the difference that, in place of the phosphoric acid partial ester of Example 1 of EP 87 799 B1, there is employed the product of Example 4 of DE-OS 32 30 925. The obtained leather has a water resistance (by the Bally penetrometer test) that is superior to the one of the blanc sample [i.e. a sample produced in the same way but without the addition of Product (1)].

Analogously as the respectively employed Products (1) to (5), there are employed in the above Application Examples A to J each of the other of the Products (1) to (5).

What is claimed is:

1. A process for the treatment of leather or pelts which comprises treating said leather or pelts with the alkali metal or ammonium salt of a polymeric carboxylic acid (A) containing α-hydroxyacrylic acid units at a process stage selected from:

before the mineral tanning of said leather or pelts;

directly after the mineral tanning of said leather or pelts;

directly before the mineral re-tanning of said leather or pelts;

after the mineral re-tanning of the leather or pelts; and during fatliquoring, wherein the fatliquor includes polyvalent metal cations.

2. A process of claim 1 wherein A is a copolymer comprising α-hydroxyacrylic acid units and non-ionic or anionic co-monomer units.

3. A process of claim 1 wherein A is added to a treatment bath for fatliquoring-fixation of the leather, said treatment bath containing a chrome tanning agent, and optionally, further containing another mineral tanning agent.

4. A process of claim 1 wherein A is a co-poly-α-hydroxyacrylic acid containing one or more monomeric units selected from the group consisting of methacrylic, acrylic, crotonic, itaconic, aconitic, citraconic, and maleic acid.

5. A process of claim 1 wherein the content of α-hydroxyacrylic acid units is less than 50 mol-% based on the total of monomeric units in A.

6. A process of claim 1 wherein A is in the sodium salt form and has an average numerical molecular weight in the range of 500 to 100,000.

7. A process of claim 1 wherein A is employed before mineral tanning.

8. A process of claim 1 wherein the treatment with A is carried out after pickling in an exhausted picklebath.

9. A process of claim 1 wherein A is employed directly before or after the addition of at least a part of a mineral tanning agent for re-tanning.

10. A process of claim 1 wherein A is employed during fatliquoring.

11. A process of claim 1 wherein re-tanning or fatliquoring is carried out with a chrome tanning agent, optionally in conjunction with another mineral tanning agent.

12. In a process for the treatment of leather or pelts with a mineral tanning agent, re-tanning agent or after-treatment agent, the improvement which comprises: treating said leather or pelts with the alkali metal or ammonium salt of a polymeric carboxylic acid (A) containing α-hydroxyacrylic acid units at a process stage selected from:

before the mineral tanning of said leather or pelts;

directly after the mineral tanning of said leather or pelts;

directly before the mineral re-tanning of said leather or pelts;

after the mineral re-tanning of said leather or pelts; and during fatliquoring, wherein the fatliquor includes polyvalent metal cations.

13. A process of claim 12 wherein A is a copolymer comprising α-hydroxyacrylic acid units and non-ionic or anionic co-monomer units.

14. A process of claim 12 wherein A is added during fatliquoring, the fatliquor containing a chrome tanning agent and, optionally, further containing another mineral tanning agent.

15. A process of claim 12 wherein A is a co-poly-α-hydroxyacrylic acid containing one or more monomer units selected from the group consisting of:

methacrylic, acrylic, crotonic, itaconic, aconitic, citraconic, and maleic acid.

16. A process of claim 12 wherein the content of α-hydroxyacrylic acid units is less than 50 mol-% based on the total of monomeric units in A.

17. A process of claim 12 wherein A is in the sodium salt form and has an average numerical molecular weight in the range of 500 to 100,000.

18. A process of claim 12 wherein A is employed after bating and mineral tanning.

19. A process of claim 12 wherein the treatment with A is carried out after pickling in an exhausted picklebath.

20. A process of claim 12 wherein A is employed directly before or after the addition of at least a part of a mineral tanning agent for re-tanning.

21. A process of claim 12 wherein A is employed during fatliquoring.

22. A process of claim 12 wherein A is added to a treatment bath for retanning the leather, said treatment bath containing a chrome tanning agent and, optionally, further containing another mineral tanning agent.

* * * * *